US011134757B2

(12) United States Patent
Torigoe et al.

(10) Patent No.: US 11,134,757 B2
(45) Date of Patent: Oct. 5, 2021

(54) FASTENER STRINGER ATTACHMENT STRUCTURE

(71) Applicants: Gotalio Co., Ltd., Kanagawa (JP); YKK Corporation, Tokyo (JP)

(72) Inventors: Noriko Torigoe, Yokohama (JP); Shoji Matsui, Tokyo (JP); Hisashi Masuda, Tokyo (JP)

(73) Assignees: Gotalio Co., Ltd., Kanagawa (JP); YKK Corporation, Tokyo (JP)

( * ) Notice: Subject to any disclaimer, the term of this patent is extended or adjusted under 35 U.S.C. 154(b) by 0 days.

(21) Appl. No.: 16/315,749

(22) PCT Filed: Jul. 11, 2016

(86) PCT No.: PCT/JP2016/070461
§ 371 (c)(1),
(2) Date: Jan. 7, 2019

(87) PCT Pub. No.: WO2018/011866
PCT Pub. Date: Jan. 18, 2018

(65) Prior Publication Data

US 2019/0328088 A1 Oct. 31, 2019

(51) Int. Cl.
*A44B 19/40* (2006.01)
*A44B 19/34* (2006.01)

(52) U.S. Cl.
CPC ..... *A44B 19/40* (2013.01); *A44B 19/343* (2013.01)

(58) Field of Classification Search
CPC ..... A44B 19/343; A44B 19/40
See application file for complete search history.

(56) References Cited

U.S. PATENT DOCUMENTS 2,103,985 A 12/1937 Jacobs
2,218,089 A 10/1940 Marinsky
3,278,945 A 10/1966 Croonborg
(Continued)

FOREIGN PATENT DOCUMENTS

CN 102395294 A 3/2012
CN 207444425 U 6/2018
(Continued)

OTHER PUBLICATIONS

European Extended Search Report, European Patent Application No. 16908770.7, Dec. 3, 2019.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

Provided is a fastener stringer attachment structure which can provide an attractive pants silhouette, improve the fit of the pants, and furthermore, reduce the manufacturing cost of the pants by reducing the number of superposed fabrics at a side edge section of a lower front bodice. A fastener tape of a fastener stringer is sewn with a sewing thread to the upper surface of a lower side fabric so that a fastener element of the fastener stringer is positioned inside an end section of the lower side fabric, and a portion of the sewing thread positioned over the fastener tape is in contact with the upper surface of the fastener tape.

14 Claims, 6 Drawing Sheets

(56) References Cited

U.S. PATENT DOCUMENTS

| | | | | |
|---|---|---|---|---|
| 3,718,105 | A | 2/1973 | Glindmeyer | |
| 3,962,729 | A * | 6/1976 | Cook | A41H 37/003 2/234 |
| 4,251,913 | A | 2/1981 | Clearwater | |
| 6,330,892 | B1 | 12/2001 | Shimono | |
| 6,571,432 | B1 * | 6/2003 | Rindle | A41D 27/201 24/389 |
| 6,651,254 | B1 * | 11/2003 | Chang | A41D 3/04 2/87 |
| 6,668,384 | B1 * | 12/2003 | Chang | A41D 3/00 2/96 |
| 6,675,390 | B1 * | 1/2004 | Chang | A41D 3/00 2/96 |
| 7,386,893 | B2 * | 6/2008 | Chang | A41D 3/00 2/87 |
| 2002/0184926 | A1 | 12/2002 | Matsuda | |
| 2003/0024034 | A1 | 2/2003 | Hosogai | |
| 2005/0178161 | A1 | 8/2005 | Matsuda et al. | |
| 2013/0174767 | A1 | 7/2013 | Hirokawa et al. | |
| 2014/0123444 | A1 | 5/2014 | Uozumi et al. | |
| 2019/0328088 | A1 | 10/2019 | Torigoe et al. | |

FOREIGN PATENT DOCUMENTS

| | | | |
|---|---|---|---|
| JP | 2000-303298 | A | 10/2000 |
| JP | 2002-360316 | A | 12/2002 |
| JP | 2003-073906 | A | 3/2003 |
| JP | 2005-230040 | A | 9/2005 |
| JP | 2007-002367 | A | 1/2007 |
| JP | 3184077 | U | 6/2013 |
| TW | 201102016 | A | 1/2011 |
| WO | 2011/007411 | A1 | 1/2011 |
| WO | 2012-042616 | A1 | 4/2012 |
| WO | 2013-011559 | A1 | 1/2013 |
| WO | 2018-012008 | A1 | 1/2018 |

OTHER PUBLICATIONS

Office Action, Japanese Patent Application No. 2018-527270, dated Oct. 29, 2019.

International Search Report, PCT Patent Application No. PCT/JP2016/070461, dated Aug. 23, 2016.

Written Opinion, PCT Patent Application No. PCT/JP2016/070461, dated Aug. 23, 2016.

International Search Report, PCT Patent Application No. PCT/JP2016/086759, dated Mar. 7, 2017.

Written Opinion, PCT Patent Application No. PCT/JP2016/086759, dated Mar. 7, 2017.

International Preliminary Report on Patentability, PCT Patent Application No. PCT/JP2016/070461, dated Jan. 15, 2019.

International Preliminary Report on Patentability, PCT Patent Application No. PCT/JP2016/086759, dated Jan. 15, 2019.

Office Action, Chinese Patent Application No. 201710561463.9, dated Feb. 5, 2020.

* cited by examiner

FASTENER STRINGER ATTACHMENT STRUCTURE

TECHNICAL FIELD

The present invention relates to a fastener stringer attachment structure for a slide fastener to be attached to a front opening of pants, an opening portion of a skirt, an opening portion of a hem slit of pants, an opening portion of a sweater, an opening portion of shoes or boots.

BACKGROUND ART

Conventionally, as shown in FIG. 7, a slide fastener 10 for opening and closing a front opening P1 of pants P is attached to the front opening P1. Further, as shown in FIG. 8, the slide fastener 10 includes a pair of stringers 11, 12, one fastener stringer 11 is sewn to a side edge portion P21 of the lower front body (lower side fabric) P2 of the pants P, and the other fastener stringer 12 is sewn to a side edge portion P31 of an upper front body (upper side fabric) P3 of the pants P. Incidentally, in FIG. 8, reference symbol T denotes a fastener tape and reference character E denotes a fastener element.

Further, one fastener stringer 11 is disposed between the side edge portion P21 of the lower front body P2 and a fly F1 and sewn with a one-seam sewing thread S1 to the side edge portion P21 of the lower front body P2 and the fly F1. In addition, the side edge portion P21 of the lower front body P2 includes a folded portion P22 which is folded back to the lower surface side. In addition, the fly F1 includes front and back fabrics F11 and F12, one side edge portion of each of the front and back fabrics F11 and F12 is folded back inward, the folded back portions thereof are sewn together with a one-seam sewing thread S2, and the other side edge portions are sewn to each other with a one-seam sewing thread S3. Therefore, the fastener stringer attachment structure on the lower front body P2 side has a structure in which five fabrics are superposed. Incidentally, the above-mentioned fly F1 is for preventing the fabric of clothing inside the slide fastener or the like and skin from being engaged with the slide fastener.

In addition, the reason for sewing the lower front body P2 folded back at the side edge portion P21 and superposed the upper side of the fastener tape T is to reduce appearance width (exposure width) of the fastener tape T to make the appearance look slim and to suppress the fastener tape T from being flapped by floating from a stitch. Normally, since a general-purpose slide fastener is premised on sewing and superposing with the fabric to which the fastener is attached, and the tape width has been prepared with a margin so as to be 12 mm to 15 mm or more, sewing with superposing as described above is inevitable. Incidentally, in this specification, the tape width of the fastener refers to a distance between the side edge end portion on the element side and the side edge end portion on the side without the element of the fastener tape in one fastener stringer 11 as described as W0 in FIG. 8.

In addition, the other fastener stringer 12 is sewed to the lower surface side of the upper front body P3 by a two-seam sewing thread S4 via a fabric piece F2. The fabric piece F2 is sewed to the lower surface side of the upper front body P3 by one-seam sewing threads S5, S6. In addition, the side edge portion P31 of the upper front body P3 includes a folded portion P32 which is folded back to the lower surface side. In addition, the fabric piece F2 includes a folded portion F21 which is folded back to the upper surface side.

Therefore, the fastener stringer attachment structure on the upper front body P3 side has a structure in which three fabrics are superposed.

SUMMARY OF THE INVENTION

Technical Problem

Merely, in the above-described conventional fastener stringer attachment structure, since the structure is a structure in which five fabrics are superposed on the lower front body P2 side, the periphery of the side edge portion P21 of the lower front body P2 is thick, and it is hardly to obtain a beautiful silhouette of pants P and the fit feeling of pants P is lowered. In addition, the manufacturing cost of pants P has increased since there are many sewn portions. In addition, since an end edge of the folded portion P22 of the lower front body P2, an end edge of the fastener tape T of one fastener stringer 11, and the edge of the fabrics F11, F12 of the fly F1 are disposed at the same position in a width direction, the fabric amount changes greatly and it is hardly to obtain a beautiful silhouette of pants P. Further, the thickness of the side edge portion P21 has been increased more than the number of superposed fabrics since the above-mentioned end edges are overlocked.

The present invention has been made in view of the above-described circumstances, and an object thereof is to provide a fastener stringer attachment structure which can provide a beautiful silhouette of pants by reducing the number of superposed fabrics at a side edge portion of a lower front body, and improve the fit feeling of pants, and furthermore, reduce the manufacturing cost of the pants.

Solution to Problem

The above object of the present invention is achieved by the following configurations.

(1) A fastener stringer attachment structure for a lower side fabric in an upper side fabric and the lower side fabric configured to be opened and closed by fastener stringers respectively attached thereto, wherein a fastener tape of the fastener stringer is sewn with a sewing thread to an upper surface of the lower side fabric so that a fastener element of the fastener stringer is disposed at an inner side with respect to an end portion of the lower side fabric, and a portion of the sewing thread positioned above the fastener tape is in contact with an upper surface of the fastener tape.

(2) The fastener stringer attachment structure according to (1), wherein the fastener tape of the fastener stringer is sewn with one seam to the lower side fabric.

(3) The fastener stringer attachment structure according to (1) or (2), wherein a tape width of the fastener tape is 3 mm to 10 mm.

(4) The fastener stringer attachment structure according to any one of (1) to (3), wherein a reserve amount of the upper side fabric is 3 mm to 12 mm, and the fastener stringer sewn to the lower side fabric is completely covered by the upper side fabric.

(5) The fastener stringer attachment structure according to any one of (1) to (3), wherein the fastener tape is a knitted tape.

Advantageous Effect

According to the present invention, a fastener tape of a fastener stringer is sewn with a sewing thread to the upper surface of a lower side fabric such that a fastener element of the fastener stringer is an inner side with respect to an end portion of the lower side fabric, and a portion of the sewing thread positioned over the fastener tape is in contact with the upper surface of the fastener tape, so that the number of superposed fabrics at a side edge portion of the lower side fabric can be reduced. Therefore, a beautiful silhouette of pants can be provided, and the fit feeling of pants can be improved. Furthermore, the manufacturing cost of the pants can be reduced since the number of sewn portions can be reduced.

DESCRIPTION OF EMBODIMENTS

Hereinafter, pants in which one embodiment of a fastener stringer attachment structure according to the present invention is adopted will be described in detail with reference to the drawings.

Figure 1:
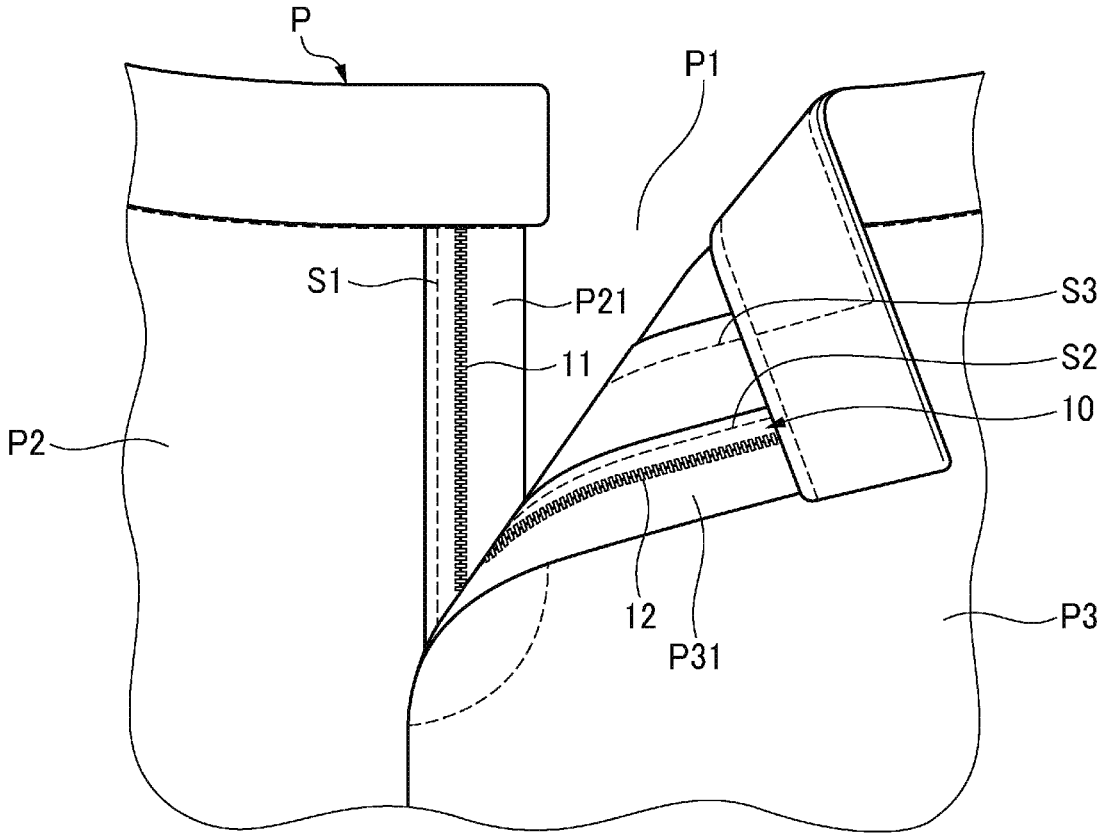
FIG. 1 is a front view of a front opening of a pair of pants in which one embodiment of a fastener stringer attachment structure according to the present invention is adopted.
Figure 2:
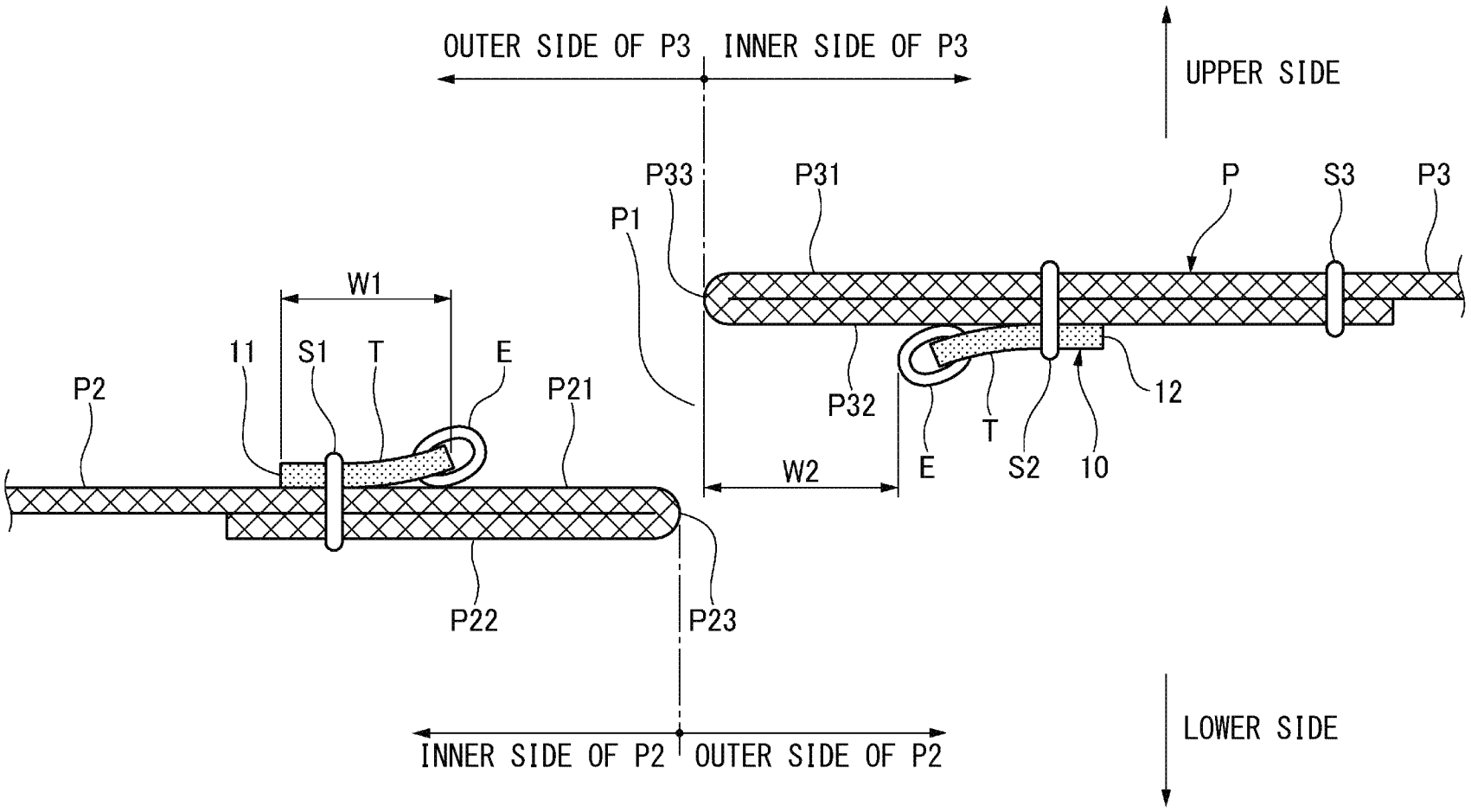
FIG. 2 is a cross-sectional view of a periphery of the slide fastener shown in FIG. 1.

As shown in FIGS. 1 and 2, the pants P in which the fastener stringer attachment structure of the embodiment is adopted include a lower front body (lower side fabric) P2 and an upper front body (upper side fabric) P3 having a front opening P1, and a slide fastener 10 for opening and closing the front opening P1 thereof. Incidentally, in the embodiment, a lower side is defined as a side closer to a storage object than a fastener in the closed state of the fastener, and the opposite side is defined as the upper side (see the description of the arrow in FIG. 2). Incidentally, the storage object is an object to be confined by the fastener, for example, a body in the case of the pants, a bag storage in the case of a bag and feet in case of the boots.

In addition, an outer side is defined as a direction side (fastener closing direction side) which is engaged with the other fastener element E in a tape width direction of the fastener when viewed from one fastener element E of the fastener, and the opposite side is defined as an inner side. As described in the arrow in FIG. 2, the inner side of the lower front body P2 means the outer side when viewed from the upper front body P3. In addition, the width direction of the tape width W1 in FIG. 2 is simply referred to as a width direction.

Figure 7:
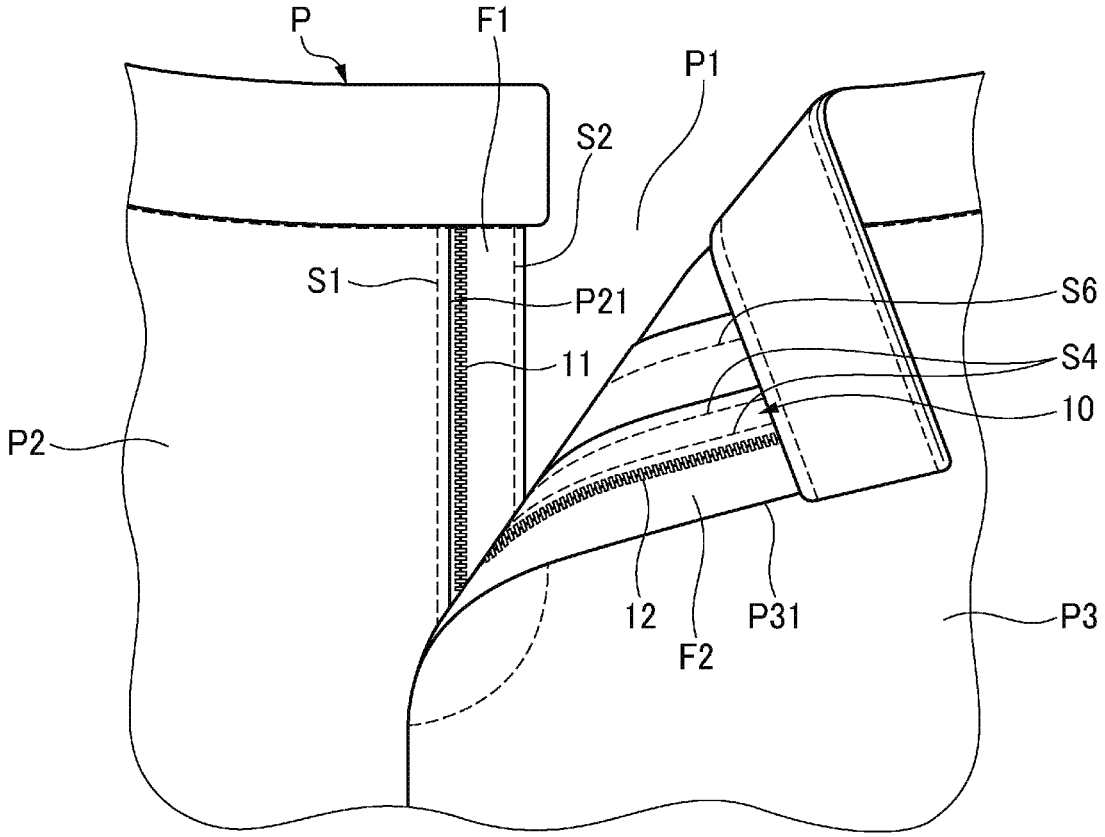
FIG. 7 is a front view of a front opening of a pair of pants for explaining a conventional fastener stringer attachment structure.
Figure 8:
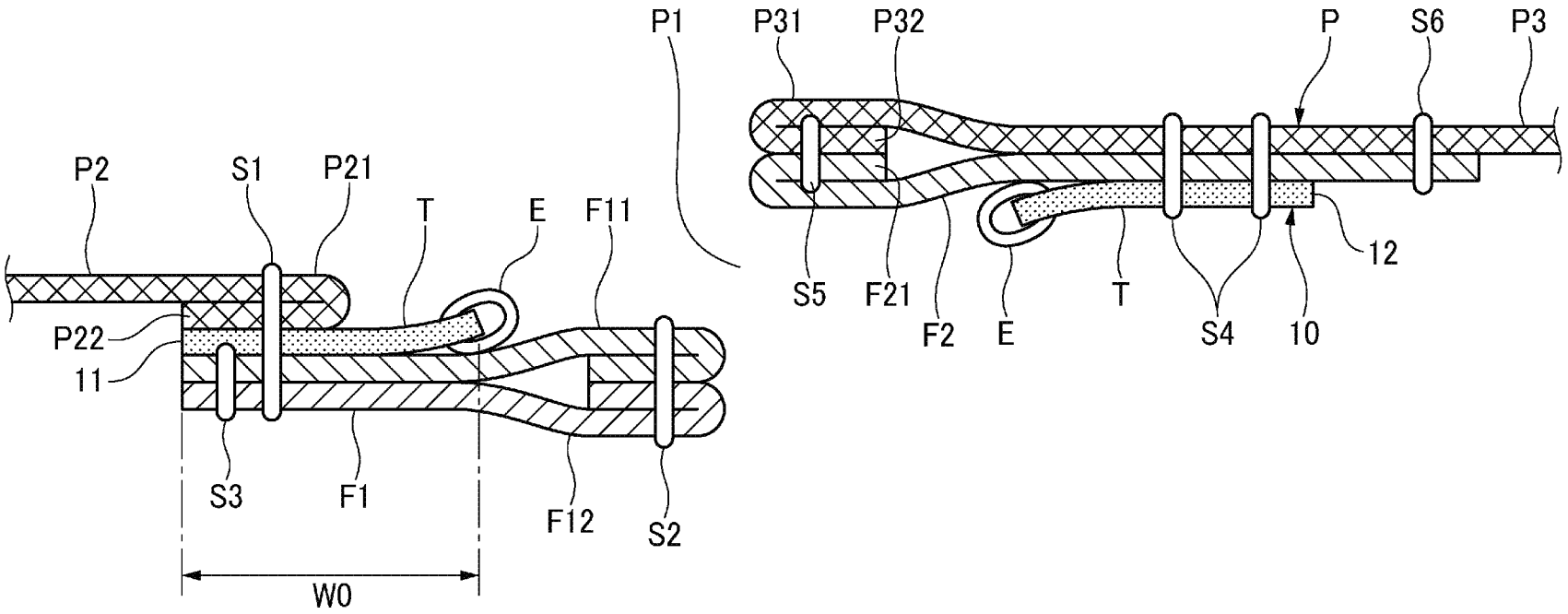
FIG. 8 is a cross-sectional view of a periphery of the slide fastener shown in FIG. 7.

Incidentally, in the specification, the upper side fabric and the lower side fabric refer to fabrics which are connected without cutting from the fabrics constituting at least a part of an outer peripheral surface of the main body (pants, bags, shoes, etc.) of the sewn article to which the fastener is attached, and do not include auxiliary fabrics or lining fabrics which do not constitute the outer peripheral surface of the main body, such as the fly F1 described in the prior art of FIGS. 7 and 8.

The slide fastener 10 includes a pair of fastener stringers 11, 12 as shown in FIG. 2, one fastener stringer 11 is sewn to the side edge portion P21 of the lower front body (lower side fabric) P2 of the pants P, and the other fastener stringer 12 is sewn to a side edge portion P31 of the upper front body (upper side fabric) P3 of the pants P. The pair of fastener stringers 11, 12 each include a fastener tape T and a fastener element E attached to a side edge portion of the fastener tape T. Thus, the lower front body P2 and the upper front body P3 are configured to be opened and closed by the pair of fastener stringers 11, 12.

The side edge portion P21 of the lower front body P2 includes a folded portion P22 which is folded back to the lower surface side. Further, the fastener tape T of the fastener stringer 11 is sewn with a one-seam sewing thread S1 to the upper surface of the side edge portion P21 of the lower front body P2 such that the fastener element E of the fastener stringer 11 is the inner side with respect to the outer end portion P23 of the lower front body P2.

The sewing thread S1 penetrates a total of three fabrics of the fastener tape T of one fastener stringer 11, the side edge portion P21 of the lower front body P2, and the folded portion P22 of the lower front body P2. In addition, the portion of the sewing thread S1 positioned above the fastener tape T is in contact with the upper surface of the fastener tape T. In addition, an end edge of the folded portion P22 of the lower front body P2 and an end edge of the fastener tape T of one fastener stringer 11 are disposed at different positions in the width direction.

The side edge portion P31 of the upper front body P3 includes a folded portion P32 which is folded back to the lower surface side. Further, the fastener tape T of the fastener stringer 12 is sewn with a one-seam sewing thread S2 to the lower surface of the folded portion P32 of the upper front body P3 so that the fastener element E of the fastener stringer 12 is the inner side with respect to the outer end portion P33 of the upper front body P3. In addition, the inner end portion of the folded portion P32 is sewn with the one-seam sewing thread S3 to the lower surface of the side edge portion P31 of the upper front body P3.

The sewing thread S2 penetrates a total of three fabrics of the fastener tape T of the other fastener stringer 12, the folded portion P32 of the upper front body P3, and the side edge portion P31 of the upper front body P3. In addition, the portion of the sewing thread S2 positioned below the fastener tape T thereof is in contact with the lower surface of the fastener tape T. In addition, an end edge of the folded portion P32 of the upper front body P3 and an end edge of the fastener tape T of the other fastener stringer 12 are disposed at different positions in the width direction.

Further, in the fastener stringer attachment structure with this configuration, the number of superposed fabrics at the side edge portion P21 of the lower front body P2 can be reduced from five to three. Thus, a beautiful silhouette of pants P can be obtained, and the fit feeling of the pants P can be improved since it is possible to reduce the superposing of the fabrics of fastener stringer sewn portions and to reduce unevenness around the fastener stringer. In addition, the manufacturing cost of the pants can be reduced since the number of sewn portions of the side edge portion P21 of the lower front body P2 can be reduced from two or three seams to one seam. In addition, the manufacturing cost of the pants can be reduced since the number of sewn portions of the side edge portion P31 of the upper front body P3 can be reduced from four seams to two seams.

In addition, in the embodiment, the fastener tapes T of the pair of fastener stringers 11, 12 are narrower than the conventional fastener tape. Specifically, the tape width W1 (see FIG. 2) of the fastener tape T is 3 mm to 10 mm. Thus, it is possible to reduce the number of sewn portions compared with the conventional one since the sewing thread for sewing the fastener tape T can be one seam. In addition, the fastener tape T may be a woven tape, more preferably a knitted tape. This is because the thread tends to be frayed from the cut portion (the thread unravels and escapes easily) in the woven tape, but the fraying of the thread at the cut portion will not spread to the entire tape due to the characteristics of the knitting structure of the knitted tape when the conventional general-purpose fastener tape (wider than 10 mm) is cut to have a narrow width of 3 mm to 10 mm. Incidentally, in the fastener tape with the conventional width, the flapping of the fastener tape on both sides of the sewing thread is increased when sewn with a one-seam sewing thread, so it is necessary to sew with a two-seam sewing thread.

Further, since the fastener tape T has a narrow width, it is possible to reduce a reserve amount W2 of the upper front body P3 covering the upper side of one fastener stringer 11 on the lower front body P2 side. Specifically, the reserve amount W2 of the upper front body P3 is 3 mm to 12 mm (see FIG. 2). Thus, the silhouette of the pants P can be made more beautiful, and the fit feeling of the pants P can be further improved. Further, one fastener stringer 11 sewn to the lower front body P2 is completely covered by the upper front body P3. Incidentally, the reserve amount W2 of the upper front body P3 is the length of the fabric from the outer end portion P33 of the upper front body P3 to the outer end portion of the fastener element E. In addition, when using the fastener tape with the conventional width, it is necessary to enlarge the reserve amount according to the conventional tape width in order to cover up the fastener tape.

As illustrated above, according to the fastener stringer attachment structure of the embodiment, the fastener tape T of the fastener stringer 11 is sewn with the sewing thread S1 to the upper surface of the side edge portion P21 of the lower front body P2 such that the fastener element E of the fastener stringer 11 is the inner side with respect to the outer end portion P23 of the lower front body P2, and a portion of the sewing thread S1 positioned over the fastener tape T is in contact with the upper surface of the fastener tape T, so that the number of superposed fabrics at the side edge portion P21 of the lower front body P2 can be reduced. Therefore, a beautiful silhouette of pants P can be provided, and the fit feeling of pants P can be improved. In addition, it is possible to reduce the weight of the pants P since the number of fabrics can be reduced. Furthermore, the manufacturing cost of the pants P can be reduced since the number of sewn portions can be reduced.

In addition, according to the fastener stringer attachment structure of the embodiment, it is possible to reduce the reserve amount W2 of the upper front body P3 since the fastener tapes T of the pair of the fastener stringers 11, 12 are set to be narrower than the conventional fastener tape. Accordingly, the silhouette of the pants P can be made more beautiful, and the fit feeling of the pants P can be further improved.

In addition, according to the fastener stringer attachment structure of the embodiment, the change in the fabric amount at the side edge portion P21 of the lower front body P2 can be reduced since the end edge of the folded portion P22 of the lower front body P2 and the end edge of the fastener tape T of one fastener stringer 11 are disposed at different positions in the width direction. Accordingly, the silhouette of the pants P can be made more beautiful, and the fit feeling of the pants P can be further improved.

Next, a first modification of the fastener stringer attachment structure on the lower front body side will be described with reference to FIG. 3.

Figure 3:
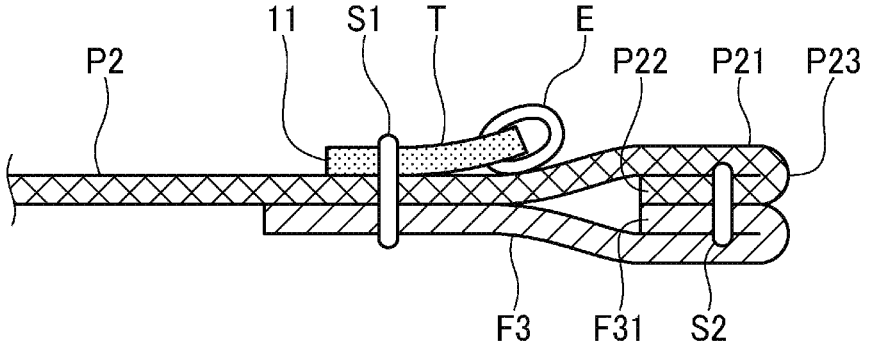
FIG. 3 is a cross-sectional view illustrating a first modification of the fastener stringer attachment structure on a lower front body side shown in FIG. 2.

In the modification, as shown in FIG. 3, the side edge portion P21 of the lower front body P2 includes the folded portion P22 which is folded back to the lower surface side, and is provided with a fabric piece F3 on the lower surface side of the side edge portion P21. The fabric piece F3 includes a folded portion F31 which is folded back to the upper surface side. Further, the fastener tape T of one fastener stringer 11 is sewed to the upper surface of the side edge portion P21 of the lower front body P2 by the one-seam sewing thread S1. The sewing thread S1 penetrates a total of three fabrics of the fastener tape T of one fastener stringer 11, the side edge portion P21 of the lower front body P2, and the fabric piece F3. In addition, the folded portion P22 of the lower front body P2 and the folded portion F31 of the fabric piece F3 are sewn together by a one-seam thread S2.

Next, a second modification of the fastener stringer attachment structure on the lower front body side will be described with reference to FIG. 4.

Figure 4:
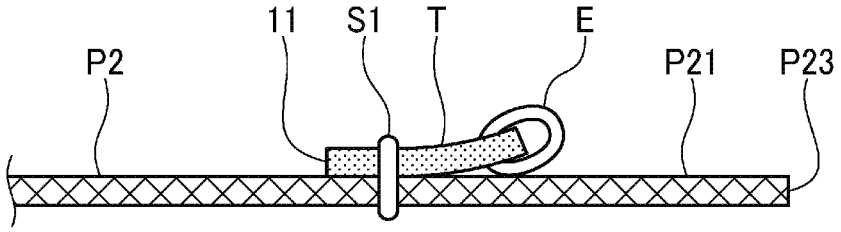
FIG. 4 is a cross-sectional view illustrating a second modification of the fastener stringer attachment structure on the lower front body side shown in FIG. 2.

In the modification, as shown in FIG. 4, the side edge portion P21 of the lower front body P2 does not include a folded portion, but the edge of the fabric of the side edge portion P21 is the outer end portion P23 of the lower front body P2. Further, the fastener tape T of one fastener stringer 11 is sewed to the upper surface of the side edge portion P21 of the lower front body P2 by the one-seam sewing thread S1. The sewing thread S1 penetrates a total of two fabrics of the fastener tape T of one fastener stringer 11 and the side edge portion P21 of the lower front body P2.

Next, a second modification of the fastener stringer attachment structure on the upper front body side will be described with reference to FIG. 5. Incidentally, the fastener stringer attachment structure of the modification has substantially the same structure as the conventional fastener stringer attachment structure on the upper front body side shown in FIG. 8.

Figure 5:
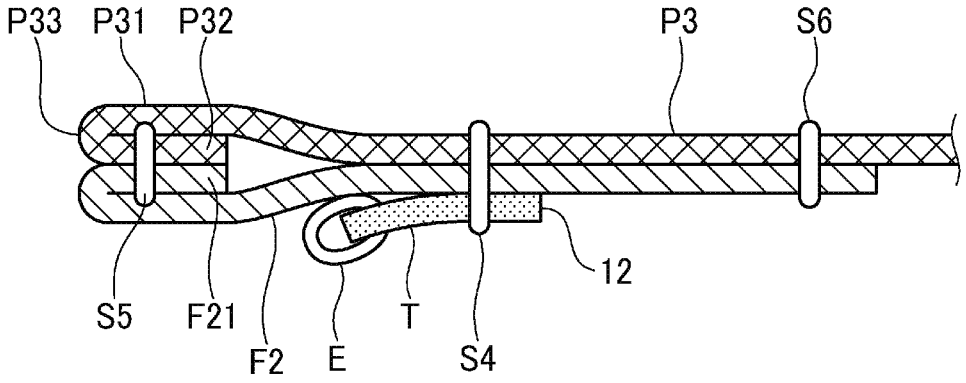
FIG. 5 is a cross-sectional view illustrating a first modification of the fastener stringer attachment structure on an upper front body side shown in FIG. 2.

In the modification, as shown in FIG. 5, the side edge portion P31 of the upper front body P3 includes the folded portion P32 which is folded back to the lower surface side, and is provided with the fabric piece F2 on the lower surface side of the side edge portion P31. The fabric piece F2 includes the folded portion F21 which is folded back to the upper surface side. Further, the fastener tape T of the other fastener stringer 12 is sewed with a one-seam sewing thread S4 to the lower surface of the fabric piece F2. The sewing thread S4 penetrates a total of three fabrics of the fastener tape T of the fastener stringer 12, the fabric piece F2, and the side edge portion P31 of the upper front body P3. In addition, the folded portion P32 of the upper front body P3 and the folded portion F21 of the fabric piece F2 are sewn together by a one-seam sewing thread S5. In addition, the inner end portion of the fabric piece F2 is sewn with a one-seam sewing thread S6 to the lower surface of the side edge portion P31 of the upper front body P3.

Next, a second modification of the fastener stringer attachment structure on the upper front body side will be described with reference to FIG. 6.

Figure 6:
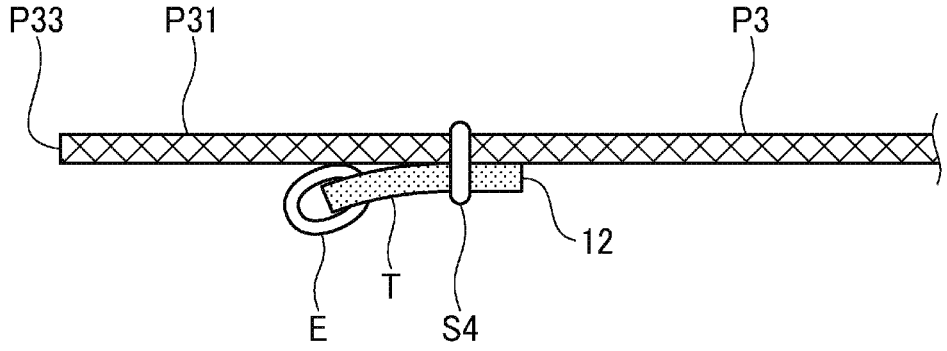
FIG. 6 is a cross-sectional view illustrating a second modification of the fastener stringer attachment structure on an upper front body side shown in FIG. 2.

In the modification, as shown in FIG. 6, the side edge portion P31 of the upper front body P3 does not include a folded portion, but the fabric edge of the side edge portion P31 is the outer end portion P33 of the upper front body P3. Further, the fastener tape T of the fastener stringer 12 is sewed with the one-seam sewing thread S4 to the lower surface of the side edge portion P31 of the upper front body P3. The sewing thread S4 penetrates a total of two fabrics of the fastener tape T of the fastener stringer 12 and the side edge portion P31 of the upper front body P3.

Incidentally, the present invention is not limited to the embodiments described above, and can be appropriately changed without departing from the spirit of the present invention.

For example, the combination of the fastener stringer attachment structure on the lower front body side and the upper front body side shown in FIGS. 2 to 6 is not limited, and the combination thereof can be freely determined.

In addition, although the case where the present invention is applied to the front opening of pants has been exemplified in the above embodiments, but it is not limited thereto, the present invention may be applied to an opening portion of a skirt, an opening portion of a hem slit of pants, an opening portion of a sweater, an opening portion of a bag, and an opening portion of shoes.

In addition, in the above embodiment, sewing of each sewing thread is preferably lock sewing and zigzag sewing. Particularly, in the case of zigzag sewing, there is an advantage that it is possible to drop the needle on one side to the fabric so as to sew and suppress the flapping of the fastener tape end.

DESCRIPTION OF REFERENCE NUMERALS

P Pants
P1 Front opening
P2 Lower front body (lower side fabric)
P23 Outer end portion of lower front body
P3 Upper front body (upper side fabric)
10 Slide fastener
11 One fastener stringer
12 The other fastener stringer
T Fastener tape
E Fastener element
S1 Sewing thread
W1 Tape width of fastener tape
W2 Reserve amount of upper front body

The invention claimed is:

1. A sewn article comprising a fastener stringer attachment structure for a lower side fabric, wherein an upper side fabric and the lower side fabric are configured to be opened and closed by fastener stringers respectively attached thereto, wherein a fastener tape of the fastener stringer is sewn with a sewing thread to an upper surface of the lower side fabric so that a fastener element of the fastener stringer is disposed on the upper surface of the lower side fabric at an inner side with respect to an end portion of the lower side fabric, wherein when the upper side fabric and the lower side fabric are closed by the fastener stringers, the upper side fabric covers the fastener stringer sewn to the lower side fabric, wherein a portion of the sewing thread positioned above the fastener tape is in contact with an upper surface of the fastener tape, and wherein the lower side fabric is connected without cutting from fabrics constituting at least a part of an outer peripheral surface of a main body of the sewn article to which the fastener stringer is attached.

2. The sewn article according to claim 1, wherein the fastener tape of the fastener stringer is sewn with one seam to the lower side fabric.

3. The sewn article according to claim 1, wherein a tape width of the fastener tape is 3 mm to 10 mm.

4. The sewn article according claim 1, wherein a reserve amount of the upper side fabric is 3 mm to 12 mm, and the fastener stringer sewn to the lower side fabric is completely covered by the upper side fabric.

5. The sewn article according to claim 1, wherein the fastener tape is a knitted tape.

6. The sewn article according to claim 1, wherein the sewing thread penetrates two or three lower side fabrics.

7. The sewn article according to claim 1, wherein the sewing thread penetrates only the following three layers: 1) the fastener tape, 2) a side edge portion of the lower side fabric, and 3) a folded portion of the lower side fabric.

8. A sewn article comprising a fastener stringer attachment structure for a lower side fabric, wherein an upper side fabric and the lower side fabric are configured to be opened and closed by fastener stringers respectively attached thereto, wherein a fastener tape of the fastener stringer is sewn with a sewing thread to an upper surface of the lower side fabric so that a fastener element of the fastener stringer is disposed on the upper surface of the lower side fabric at an inner side with respect to an end portion of the lower side fabric, wherein when the upper side fabric and the lower side fabric are closed by the fastener stringers, the upper side fabric covers the fastener stringer sewn to the lower side fabric, wherein a portion of the sewing thread positioned above the fastener tape is in contact with an upper surface of the fastener tape, and wherein the lower side fabric is directly connected to the fastener tape and the lower side fabric forms a part of an outer peripheral surface of a main body of the sewn article to which the fastener stringer is attached.

9. The sewn article according to claim 8, wherein the fastener tape of the fastener stringer is sewn with one seam to the lower side fabric.

10. The sewn article according to claim 8, wherein a tape width of the fastener tape is 3 mm to 10 mm.

11. The sewn article according to claim 8, wherein a reserve amount of the upper side fabric is 3 mm to 12 mm, and the fastener stringer sewn to the lower side fabric is completely covered by the upper side fabric.

12. The sewn article according to claim 8, wherein the fastener tape is a knitted tape.

13. The sewn article according to claim 8, wherein the sewing thread penetrates two or three lower side fabrics.

14. The sewn article according to claim 8, wherein the sewing thread penetrates only the following three layers: 1) the fastener tape, 2) a side edge portion of the lower side fabric, and 3) a folded portion of the lower side fabric.

* * * * *